US007063383B2

(12) United States Patent
Wu

(10) Patent No.: US 7,063,383 B2
(45) Date of Patent: Jun. 20, 2006

(54) SLIDING ASSEMBLY OF DYNAMIC MECHANISM OF A MASSAGE CHAIR

(76) Inventor: Shang Neng Wu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/966,978

(22) Filed: Oct. 18, 2004

(65) Prior Publication Data

US 2006/0082207 A1 Apr. 20, 2006

(51) Int. Cl.
*A47C 20/00* (2006.01)

(52) U.S. Cl. ..... 297/284.1; 297/284.2; 297/284.4; 297/284.7

(58) Field of Classification Search ..... 297/284.2, 297/284.4, 284.7, 353, 330, 284.1, 284.3
See application file for complete search history.

(56) References Cited

U.S. PATENT DOCUMENTS 4,678,231 A * 7/1987 Chizek ..... 297/329
4,715,654 A * 12/1987 Laskowitz ..... 297/329
5,567,011 A * 10/1996 Sessini ..... 297/284.7
6,013,040 A * 1/2000 Morgenstern et al. ..... 601/103
6,203,107 B1 * 3/2001 Jonsson ..... 297/337
6,309,018 B1 * 10/2001 Jernstrom ..... 297/284.1
6,352,006 B1 * 3/2002 Kurashita ..... 74/409
6,607,242 B1 * 8/2003 Estrada et al. ..... 297/216.12
6,672,668 B1 * 1/2004 Boruta et al. ..... 297/354.12
6,702,383 B1 * 3/2004 Newman et al. ..... 297/313
6,783,179 B1 * 8/2004 Komura et al. ..... 297/344.12
6,837,540 B1 * 1/2005 Yamaguchi et al. ..... 297/216.1

* cited by examiner

*Primary Examiner*—Peter M. Cuomo
*Assistant Examiner*—Erika Garrett

(57) ABSTRACT

A sliding assembly of a dynamic mechanism of a massage chair is used in a massage chair. The massage chair has a dynamic mechanism and a sliding unit. The sliding unit is movable between two tracks; each track having a first lateral plate and a second lateral plate. At least one of wheel units installed at a periphery of the sliding unit. Each wheel unit includes a first wheel, a second wheel and one elastic element. The elastic element resists one wheel outwards so that the first wheel and second wheel resist against inner sides of the two lateral plates of one respective track. Thus, since the sliding unit has wheels which are tightly resist against the lateral plates of moving tracks, no noise is generated as the dynamic mechanism of the massage chair moves.

1 Claim, 15 Drawing Sheets

SLIDING ASSEMBLY OF DYNAMIC MECHANISM OF A MASSAGE CHAIR

FIELD OF THE INVENTION

The present invention relates to massage chairs, and especially to a sliding assembly of a dynamic mechanism of a massage chair, wherein the sliding unit has wheels which tightly resistS against the lateral plates of moving tracks of the massage chair so that no noise is generated as the dynamic mechanism of the massage chair moves.

BACKGROUND OF THE INVENTION

Massage chairs are more and more popular for health reasons, which are not only used in homes, but also popular in many public places, such as amusement places.

Generally, the massage chair has a dynamic mechanism for providing the functions of massage, beating, vibration, etc. The dynamic mechanism is connected to a sliding unit for moving upwards and downwards. The sliding unit is installed between two tracks. The sliding unit is driven by a motor or a screw rod. In the prior art, the top view of the tracks is like a U shape. The wheels between the tracks have gaps to the lateral plates of the tracks so that the wheels move smoothly. However when the dynamic mechanism makes a dramatic action, noise will generate due to the wheels colliding with the tracks continuously. This will affect the users and the users will feel that the structure of the massage chair is not firm. This problem is existed almost all the massage chairs.

SUMMARY OF THE INVENTION

Accordingly, the main object of the present invention is to provide a sliding assembly of a dynamic mechanism of a massage chair, wherein the sliding unit has wheels which tightly resists against the lateral plates of moving tracks of the massage chair so that no noise is generated as the dynamic mechanism of the massage chair moves.

To achieve above object, the present invention provides a sliding assembly of a dynamic mechanism of a massage chair. The massage chair has a dynamic mechanism and a sliding unit. The sliding unit is movable between two tracks; each track having a first lateral plate and a second lateral plate. At least one of wheel units is installed at a periphery of the sliding unit. Each wheel unit includes a first wheel, a second wheel and one elastic element. The elastic element resists one wheel outwards so that the first wheel and second wheel resist against inner sides of the two lateral plates of one respective track.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Referring to append drawings, the sliding assembly of a dynamic mechanism of a massage chair of the present invention is illustrated. The present invention has the following elements.

Figure 4:
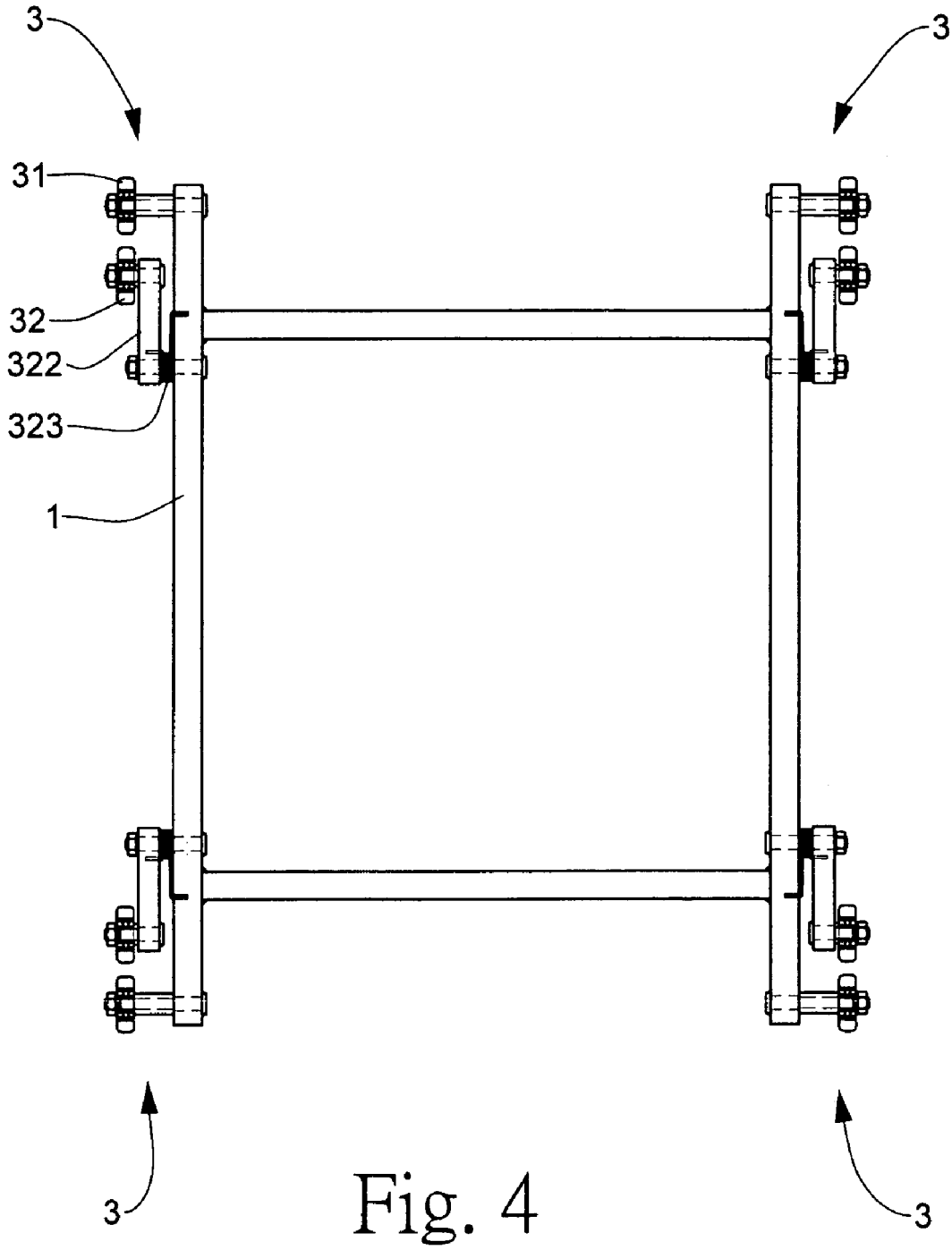
FIG. 4 is a lateral view of the lateral view of the first embodiment of the present invention.

The massage chair has a dynamic mechanism (not shown) therein for providing the functions of such as beating, vibration, massaging, etc. The dynamic mechanism is installed to a sliding unit 1. The sliding unit 1 is movable upwards and downwards and installed between two tracks 2. Each track 2 has a first lateral plate 21 and a second lateral plate 22 (see FIG. 4). The sliding unit 1 is driven by a motor 28 and a screw rod 29 to move upwards and downwards.

FIRST EMBODIMENT

Figure 1:
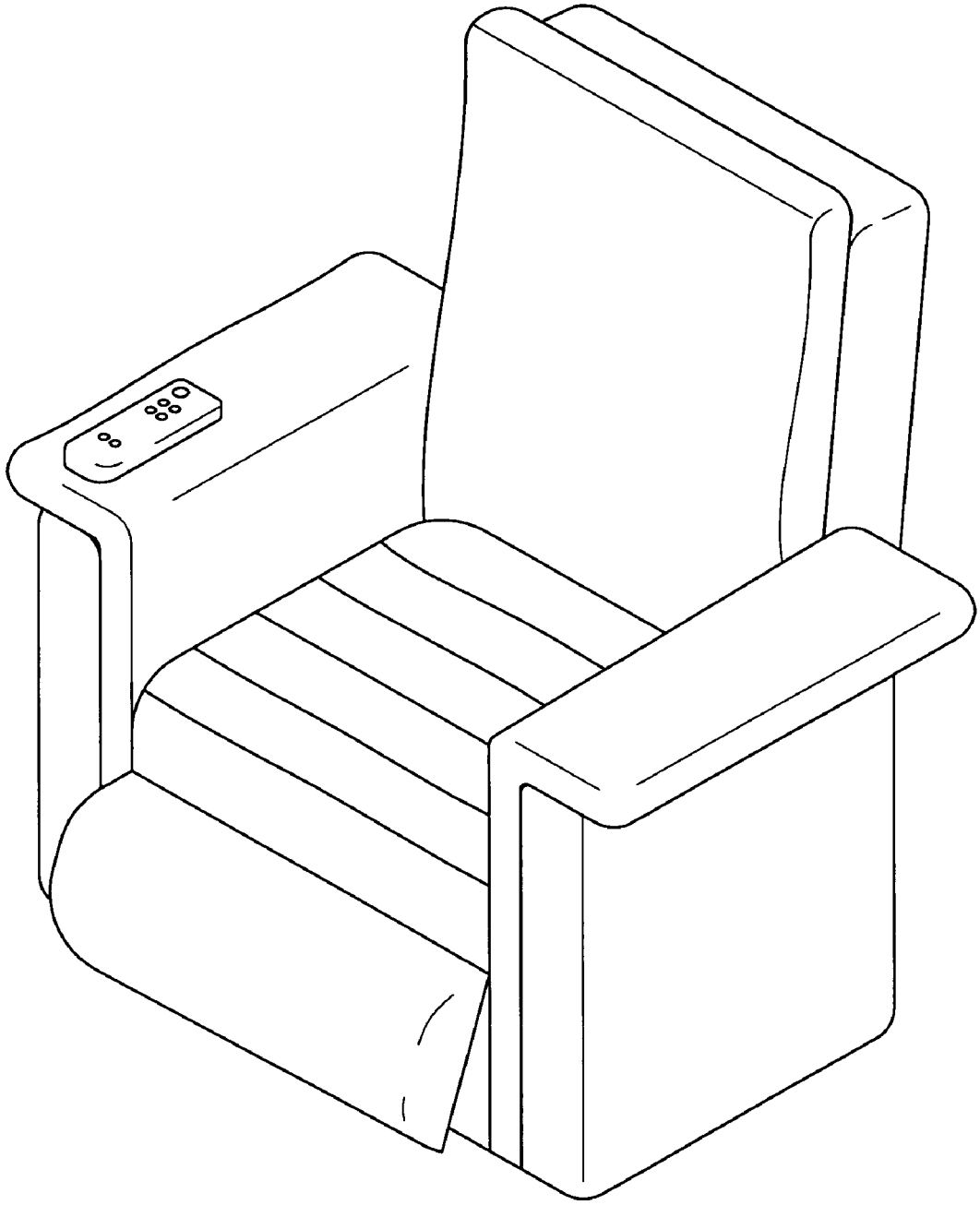
FIG. 1 is an exploded perspective view of a massage chair.
Figure 2:
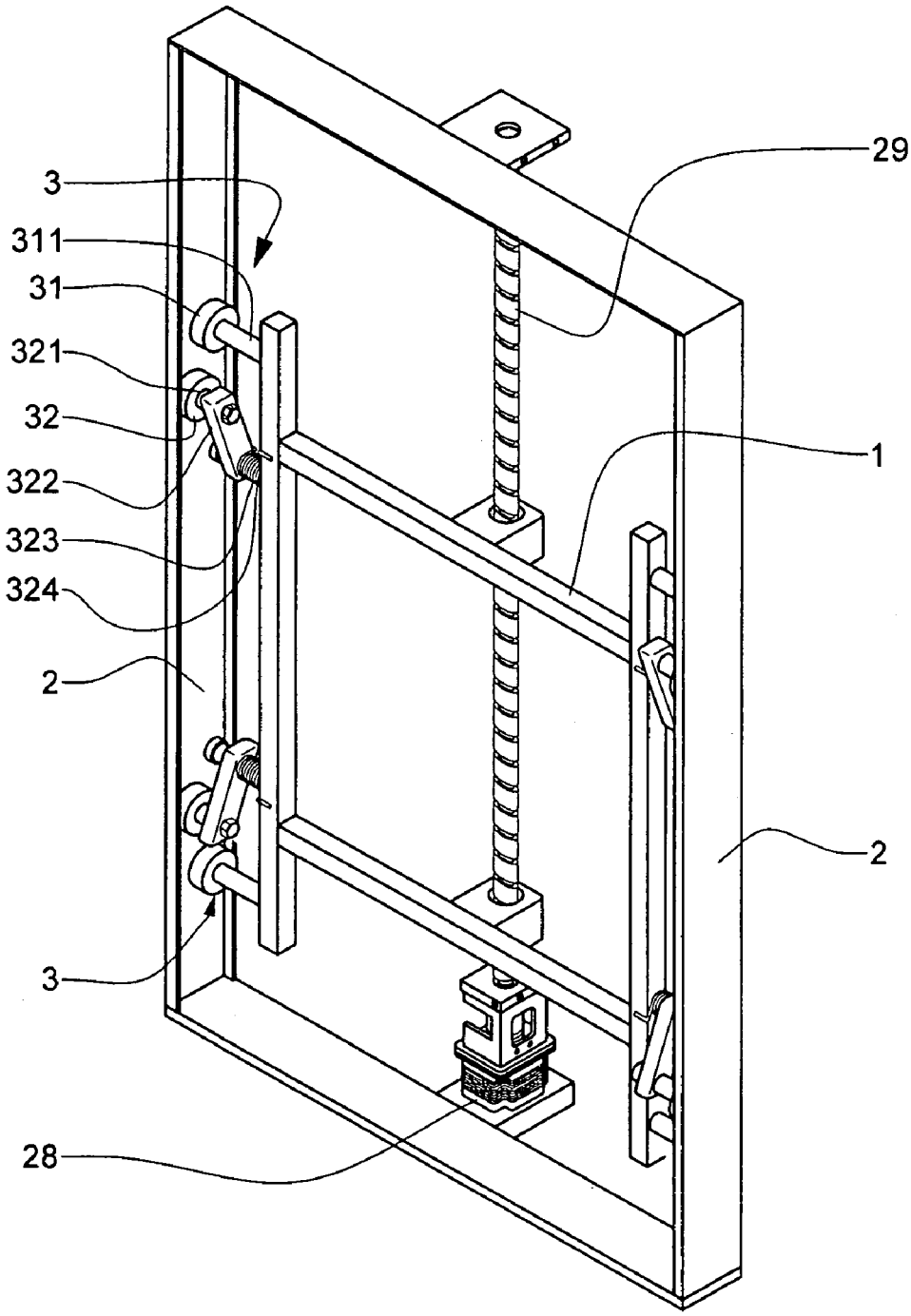
FIG. 2 is a perspective view of the first embodiment of the present invention.
Figure 3:
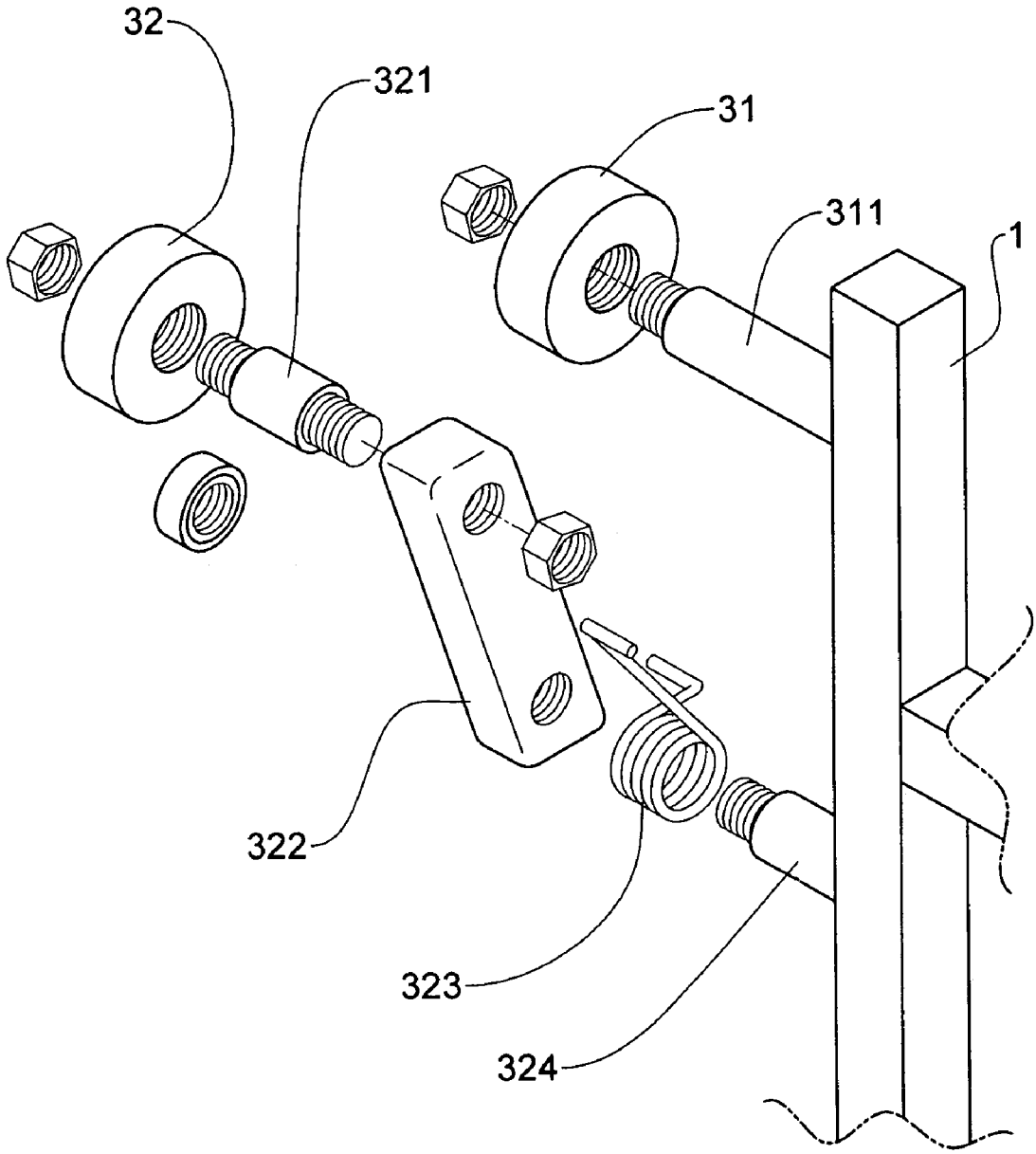
FIG. 3 is an exploded perspective view of the first embodiment of the present invention.

Referring to FIG. 1, the sliding assembly has the following elements.

At least one wheel units 3 is installed at a periphery of the sliding unit 1. Each wheel unit includes a first wheel 31 and a second wheel 32.

A first connecting shaft 311 is installed between the first wheel 31 and the sliding unit 1.

Figure 5:
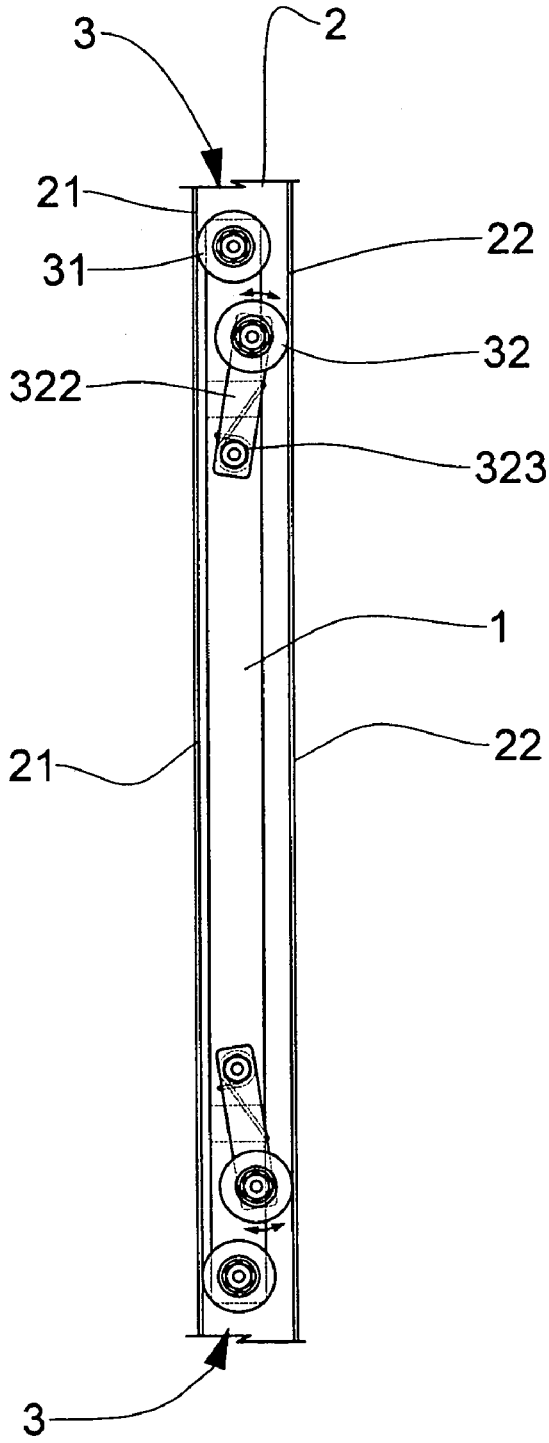
FIG. 5 is a lateral view of the first embodiment of the present invention.
Figure 6:
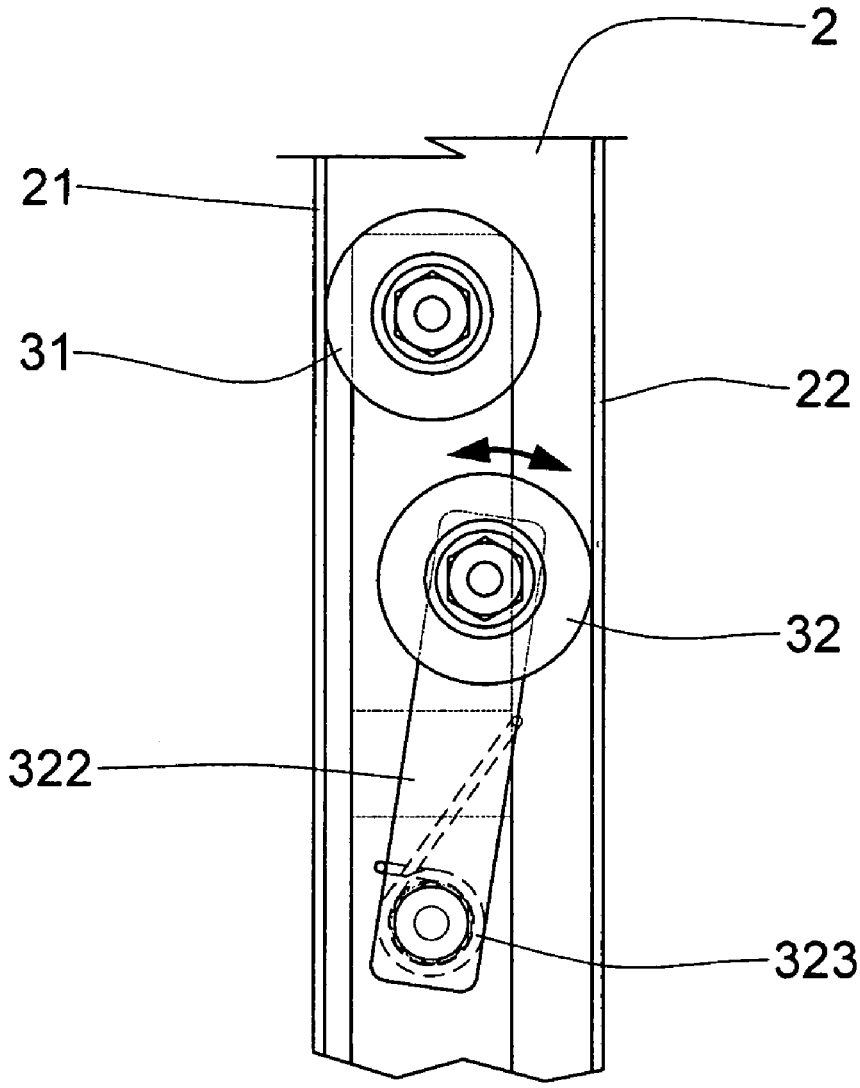
FIG. 6 is an enlarged view about the operation of the first embodiment of the present invention.

A second connecting shaft 321, a connecting block 322, an elastic element 323 and a third connecting shaft 324 are installed between the second wheel 32 and the sliding unit 1. The elastic element 323 serves to tightly press the connecting block 322 and the second wheel 32 as they move toward one side. Referring to FIG. 5, in assembly, the first wheel 31 resists against the first lateral plate 21 ands the second wheel 32 resists against the second lateral plate 22. Thus, the vibration of the dynamic mechanism will not induce the noise due to the collision of the first wheel 31 and second wheel 32 to the track 2.

SECOND EMBODIMENT

Figure 7:
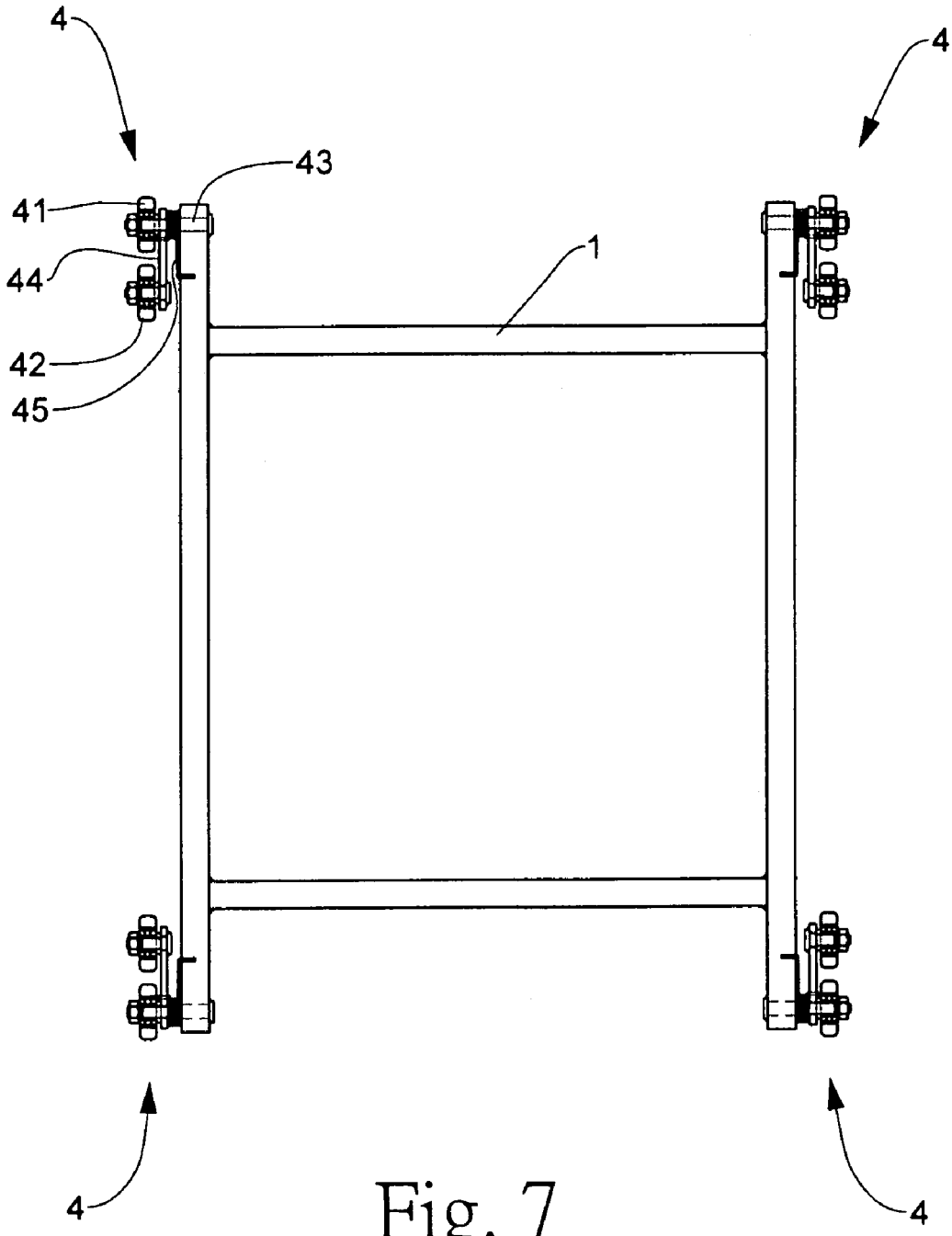
FIG. 7 is a lateral view of the second embodiment of the present invention.
Figure 8:
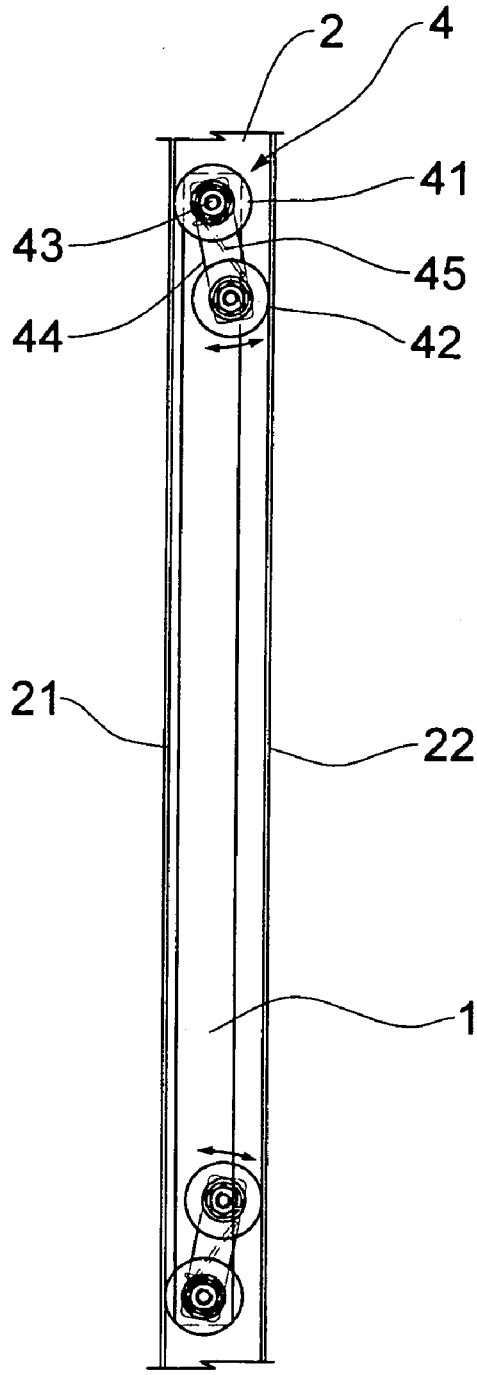
FIG. 8 is another lateral view of the second embodiment of the present invention.
Figure 9:
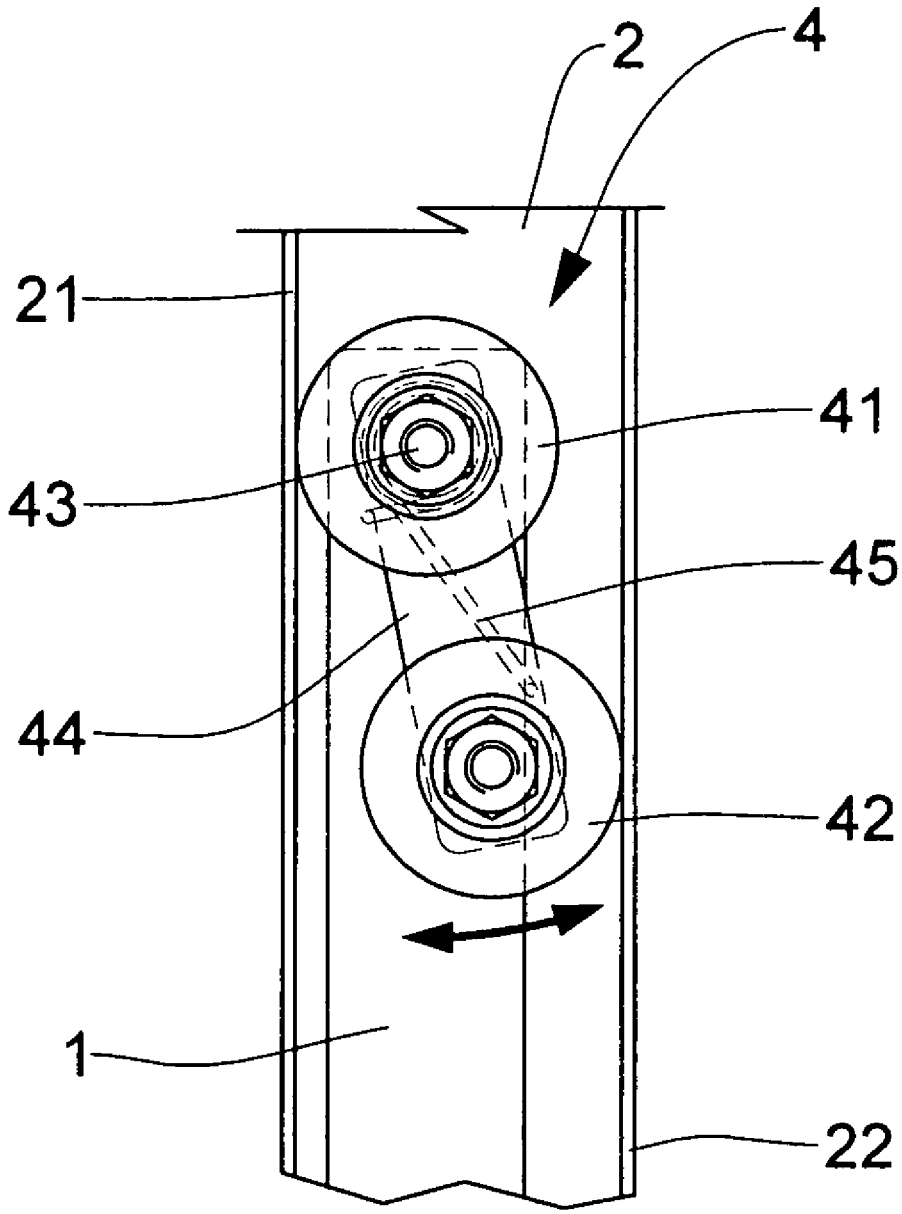
FIG. 9 is an enlarged view of the second embodiment of the present invention.

Referring to FIGS. 7, 8 and 9, in this embodiment, the wheel unit 4 has a first wheel 41 and a second wheel 42. A first connecting shaft 43 is connected between the first wheel 41 and the sliding unit 1. A connecting plate 44 has one end being assembled to the second connecting shaft 43 and another end of the connecting plate 44 is assembled to the second wheel 42. An elastic element 45 is installed on the connecting shaft 43. The elastic element 45 serves to elastically press the connecting plate 44 and the second wheel 42 to move outwards. In assembly, the first wheel 41 resists against the first lateral plate 21 and the second wheel 42 resists against the second lateral plate 22. Thus, the vibration of the dynamic mechanism will not induce the noise due to the collision of the first wheel 41 and second wheel 42 to the track 2.

THIRD EMBODIMENT

Figure 10:
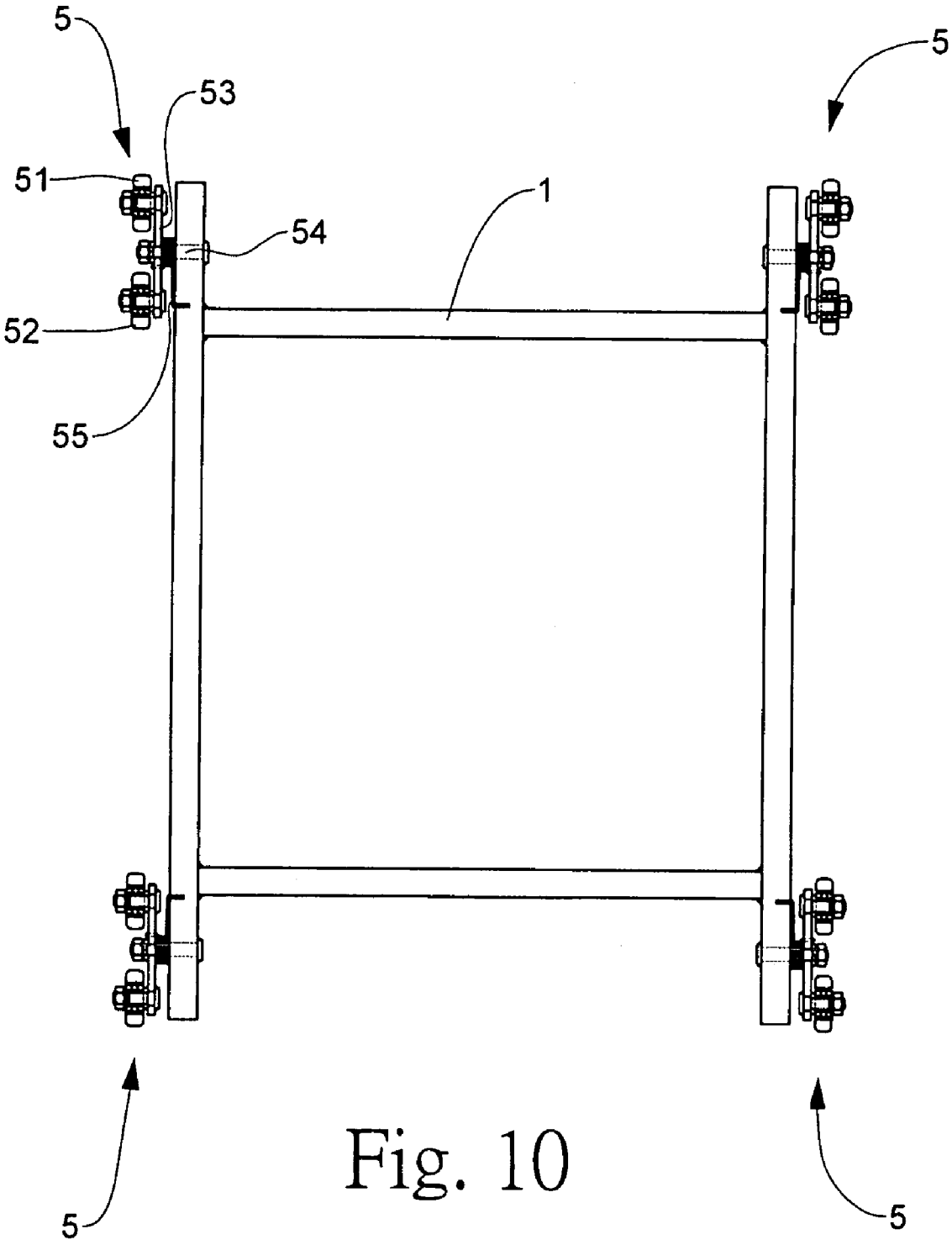
FIG. 10 is a lateral view of the third embodiment of the present invention.
Figure 11:
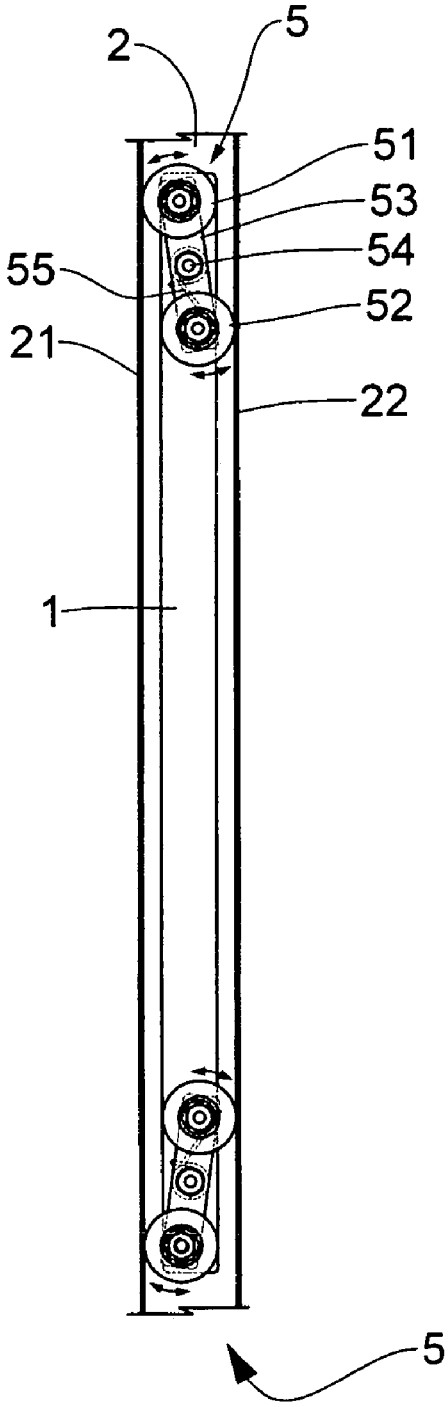
FIG. 11 is another lateral view of the third embodiment of the present invention.
Figure 12:
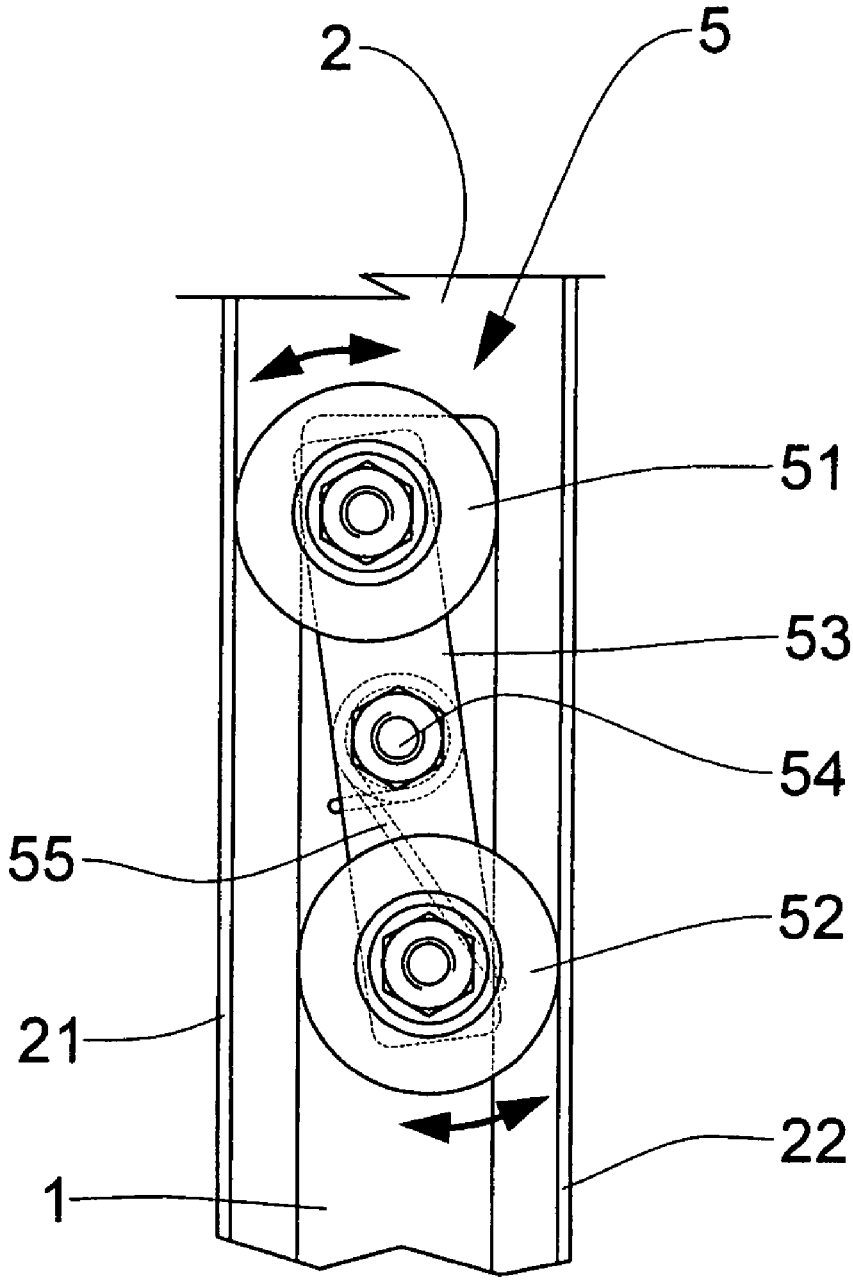
FIG. 12 is an enlarged view of the third embodiment of the present invention.

Referring to FIGS. 10, 11 and 12, in this embodiment, the wheel unit 5 includes a first wheel 51 and a second wheel 52. The first wheel 51 and the second wheel 52 are installed to a connecting plate 53. The connecting plate 53 is installed to the sliding unit 1 through a connecting shaft 54. An elastic element 55 is assembled to the connecting shaft 54 for ejecting the connecting plate 53 so as to shift one of the first wheel 51 and second wheel 52. Thereby, in assembly, the first wheel 51 resists against the first lateral plate 21 ands the second wheel 52 resists against the second lateral plate 22. Thus, the vibration of the dynamic mechanism will not induce the noise due to the collision of the first wheel 51 and second wheel 52 to the track 2.

FOURTH EMBODIMENT

Figure 13:
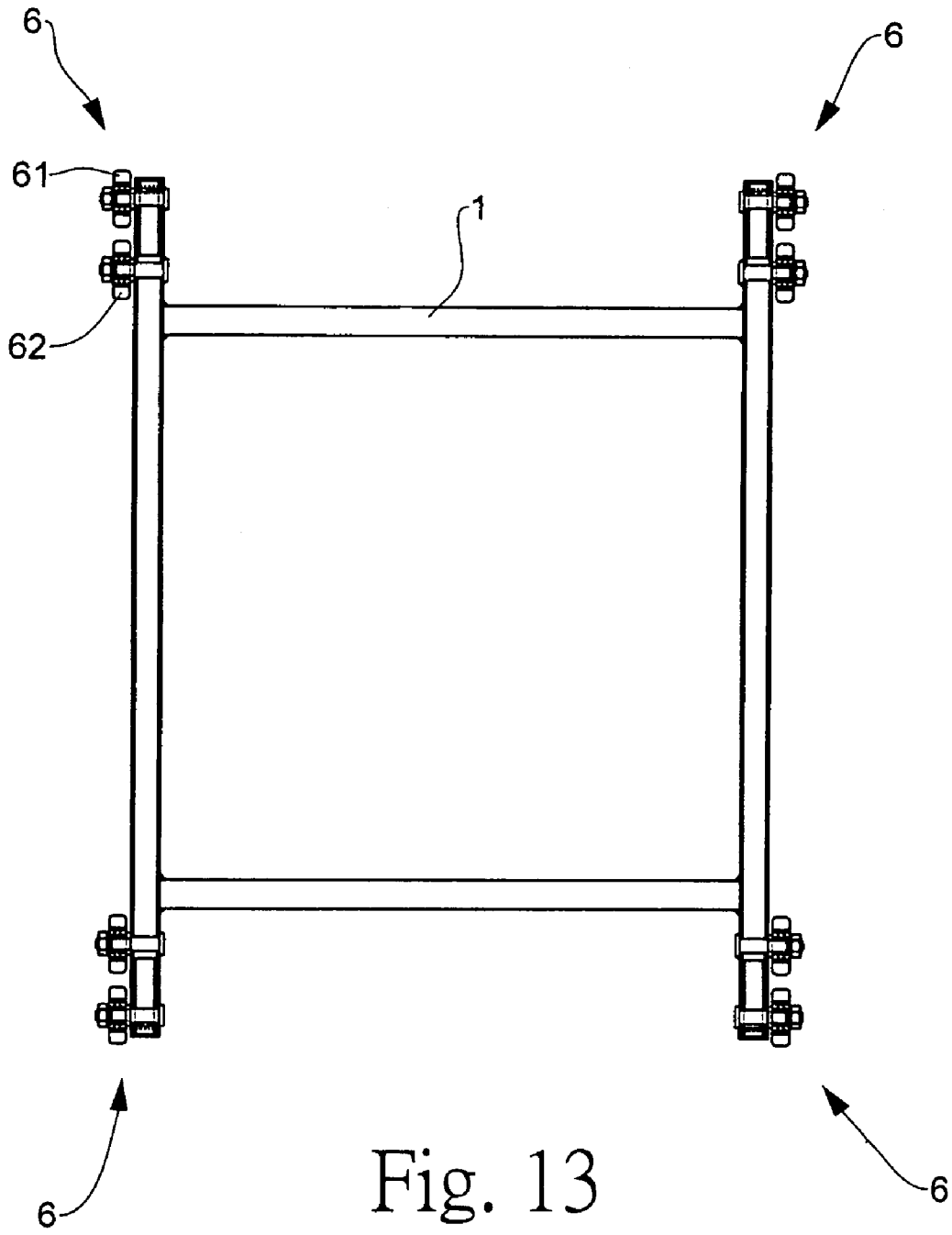
FIG. 13 is a lateral view of the fourth embodiment of the present invention.
Figure 14:
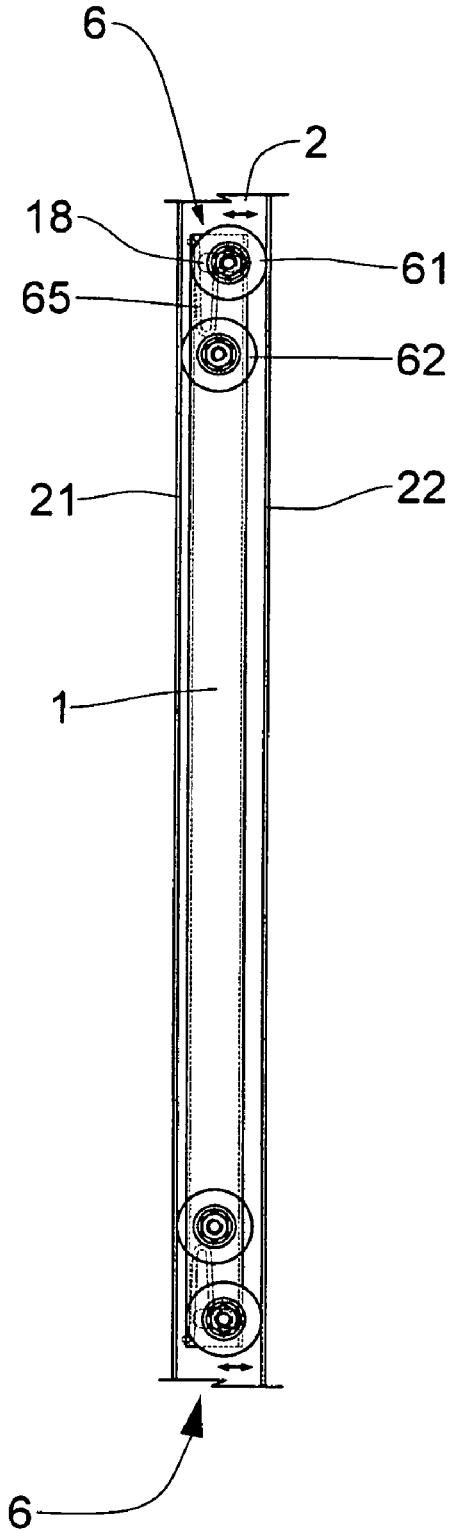
FIG. 14 is another lateral view of the fourth embodiment of the present invention.
Figure 15:
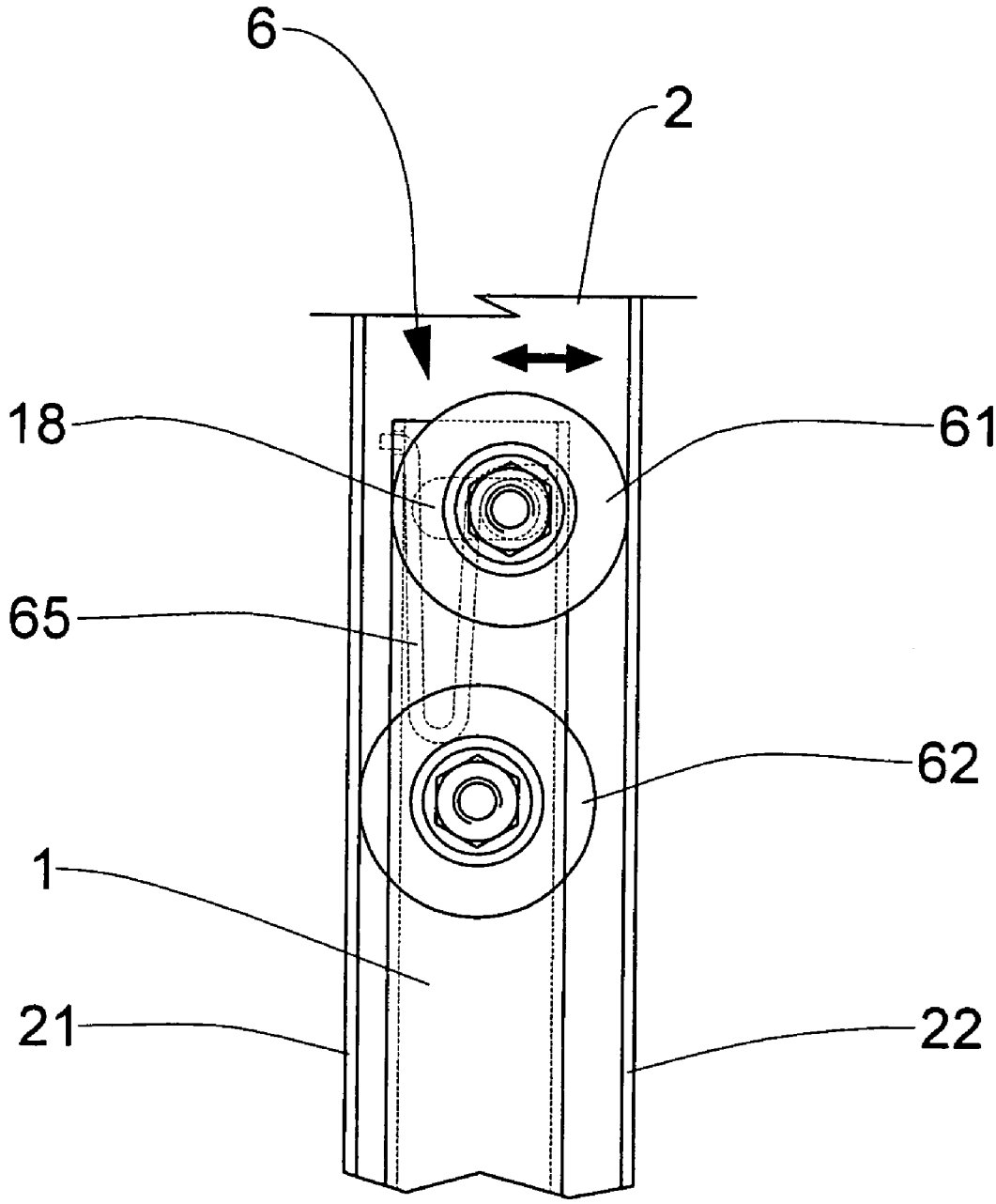
FIG. 15 is an enlarged view of the second embodiment of the present invention.

Referring to FIGS. 13, 14 and 15, the fourth embodiment of the present invention is illustrated. In this embodiment, the wheel unit 6 includes a first wheel 61 and a second wheel 62. The first wheel 61 and the second wheel 62 are installed to the sliding unit 1. The first wheel 62 is positioned on the sliding unit 1. One plate of the sliding unit 1 has a notch 18. An elastic element 65 is assembled on a center of the first wheel 61. The elastic element 65 resists the first wheel 61 toward an outer side. Thereby, in assembly, the first wheel 61 resists against the first lateral plate 21 ands the second wheel 62 resists against the second lateral plate 22. Thus, the vibration of the dynamic mechanism will not induce the noise due to the collision of the first wheel 61 and second wheel 62 to the track 2.

In summary, in above mentioned structure, the wheels resist against the inner sides of the lateral plates of the tracks by using an elastic elements and other special designs so as to avoid noises from vibration of the dynamic mechanism.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A sliding assembly of a dynamic mechanism of a massage chair used in a massage chair, the massage chair having a dynamic mechanism and a sliding unit;

the sliding unit being movable between two tracks; each track having two lateral plates at two opposite lateral sides; the sliding unit being formed by two longitudinal rods at two lateral sides and the two transversal rods installed between the two longitudinal rods; each longitudinal rod being located adjacent to a respective one of the two tracks;

four wheel units; each longitudinal rod being connected with two wheel units; each wheel unit being installed between a respective one of the two longitudinal rods and a respective track; each wheel unit further comprising:

a first wheel; a first connecting shaft installed between the first wheel and the sliding unit; and a second wheel; a second connecting shaft connected to an axis of the second wheel, a connecting block connecting to the second connecting shaft with an orientation approximately vertically to an axis of the second connecting shaft, a third connecting shaft installed between the connecting block and the respective longitudinal rod and passing through the connecting block; and an elastic element enclosing around a part of the third connecting shaft and installed between the connecting block and the respective longitudinal rod; the second connecting shaft being not coaxial to the third connecting shaft; wherein the elastic element is used to tightly press the connecting block and the second wheel as they move so as to resist against lateral plates of the respective track.

* * * * *